US006318914B1

(12) United States Patent
Cuo et al.

(10) Patent No.: US 6,318,914 B1
(45) Date of Patent: Nov. 20, 2001

(54) CARD-REVERSING DEVICE FOR USE IN CARD PRINTERS

(75) Inventors: Shi-Pyung Cuo, Hsinchu; Shih-Mim Liu, Ping-tung Hsien, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/360,844

(22) Filed: Jul. 24, 1999

(30) Foreign Application Priority Data

May 24, 1999 (TW) ..... 88108434

(51) Int. Cl.[7] ..... B41J 3/60
(52) U.S. Cl. ..... 400/188; 400/521
(58) Field of Search ..... 101/230; 271/902, 271/225, 186, 291; 400/521, 536, 541, 188; 399/364

(56) References Cited

U.S. PATENT DOCUMENTS 1,778,272 * 10/1930 Oertel ..... 101/190
5,326,179 * 7/1994 Fukai et al. ..... 400/521
5,381,209 * 1/1995 Binder et al. ..... 355/27
5,600,362 * 2/1997 Morgavi et al. ..... 347/218
5,771,058 * 6/1998 Kobayashi ..... 347/218
5,806,999 * 9/1998 Kobayashi ..... 400/188
5,941,522 * 8/1999 Hagstrom et al. ..... 271/255
6,023,114 * 2/2000 Mori et al. ..... 310/90
6,105,493 * 8/2000 Skubic et al. ..... 400/525

* cited by examiner

*Primary Examiner*—Daniel J. Colilla
(74) *Attorney, Agent, or Firm*—W. Wayne Liauh

(57) ABSTRACT

This invention relates to a card-reversing device for use with a card printer to perform printing on both sides of a card. According to the present invention, the card-reversing device includes a transmission unit capable of feeding the card, a rotary mean capable of turning the card upside down, a friction medium providing rotation torque for the rotary mean and a lock unit capable of controlling the rotation of the rotary mean. In addition, the card-reversing device of the invention is capable of turning over a card without damage as the turnover operation is abnormally stopped, and it possesses simple, easily assembled and inexpensive properties.

9 Claims, 9 Drawing Sheets

CARD-REVERSING DEVICE FOR USE IN CARD PRINTERS

FIELD OF THE INVENTION

The present invention relates to a card-reversing device for use in card printers, and more particularly, to a device for turning over a recording medium such as a telephone card to print images and/or patterns on both sides of the recording medium in conjunction with a card printer having a single printing unit capable of printing on only one side of the recording medium.

BACKGROUND OF THE INVENTION

Compact thermal card printers have been widely used for printing images or patterns on a recording medium such as an identification card, a credit card and a telephone card. In order to print such images and patterns on both sides of the card, card printers of the prior art typically include two sets of printing unit and means, causing the printers to become large in size, heavy in weight, complicated in design as well as high in cost. Since the card is the stiff material, the reversing device used in the traditional copy machines is not suitable for the card printing purpose. Hence, specially designed card-reversing (i.e., card-flipping) devices have been then used to perform printing on the both sides of the card with a printing system that is capable of printing only on one side of the card.

As one related art, the CHEETAH card printer produced by the Fargo Co. employs a clutch to turn over a card for double-side printing. Referring to FIG. 1, the roller 14 is first driven to feed the card 10 into the rotary body 12. Then, the clutch 16 is actuated to cause the rotary body 12 to be turned over by the roller 14. Although the structure of the card-reversing device is simple, the cost of the clutch 16 is expensive.

Referring to FIG. 2, the card-reversing device of the IRIS card printer produced by the NEW CODE Co. is shown. The first roller unit 17 is driven to feed the card 10 into a rotary body. The turnover motor 24 is then actuated to drive the O-ring 20 and the turnover pulley 22 to turn the card 10 over. The second roller unit 18 is used to feed the card 10 out.

In another prior art reference, a card-reversing device for a card printer is disclosed in the U.S. Pat. No. 5,771,058, which teaches the use of a device that includes four transmission means, two roller units and a rotary body. Referring to FIG. 3, the rollers 27 and 28 are used to feed the card 10 in. Driven by the belt 30, the rollers 31 and 32 can move the card 10 forward. To turn the card 10 over, the belt 34 is driven to rotate the rotary body.

In the above related art, the cost of the CHEETAH card printer is high since a clutch is used therein. The structures of the card-reversing devices in the last two related arts, i.e. the IRIS card printer and the card printer disclosed in the U.S. Pat. No. 5,771,058, are very complicated, thus increasing the difficulty of assembly and the cost of production. In addition, all card-reversing devices of the related art described above can be easily damaged, when their turnover operation is suddenly and abnormally stopped.

SUMMARY OF THE INVENTION

One objective of the invention is to provide a card-reversing device capable of turning over a card without causing damages when the turnover operation is abnormally stopped.

The other objective of the invention is to provide a simple, easily assembled and inexpensive card-reversing device.

According to the present invention, a card-reversing device used in a card printer to perform printing on both sides of a card includes a transmission unit capable of feeding the card, a rotary mean capable of turning the card upside down, a friction medium transporting a rotation torque for the rotary body and means for alternatively braking the rotation of the rotary mean.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DETAILED DESCRIPTION OF THE PREFERRED EMBODIMENTS

Figure 1:
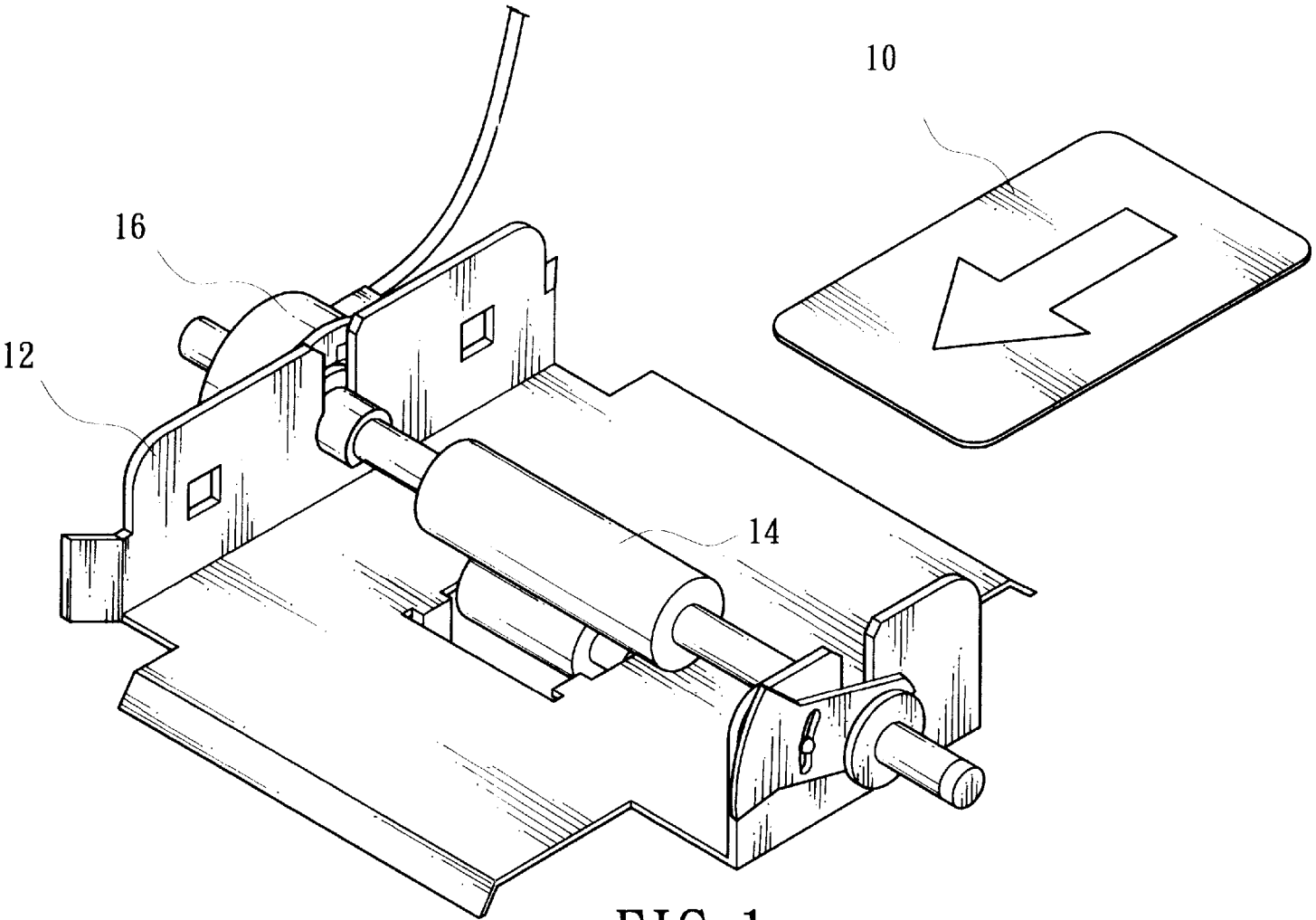
FIG. 1 (Prior Art)
FIG. 1 is a schematic perspective view showing the card-reversing device of a CHEETAH card printer produced by the Fargo Company.
Figure 2:
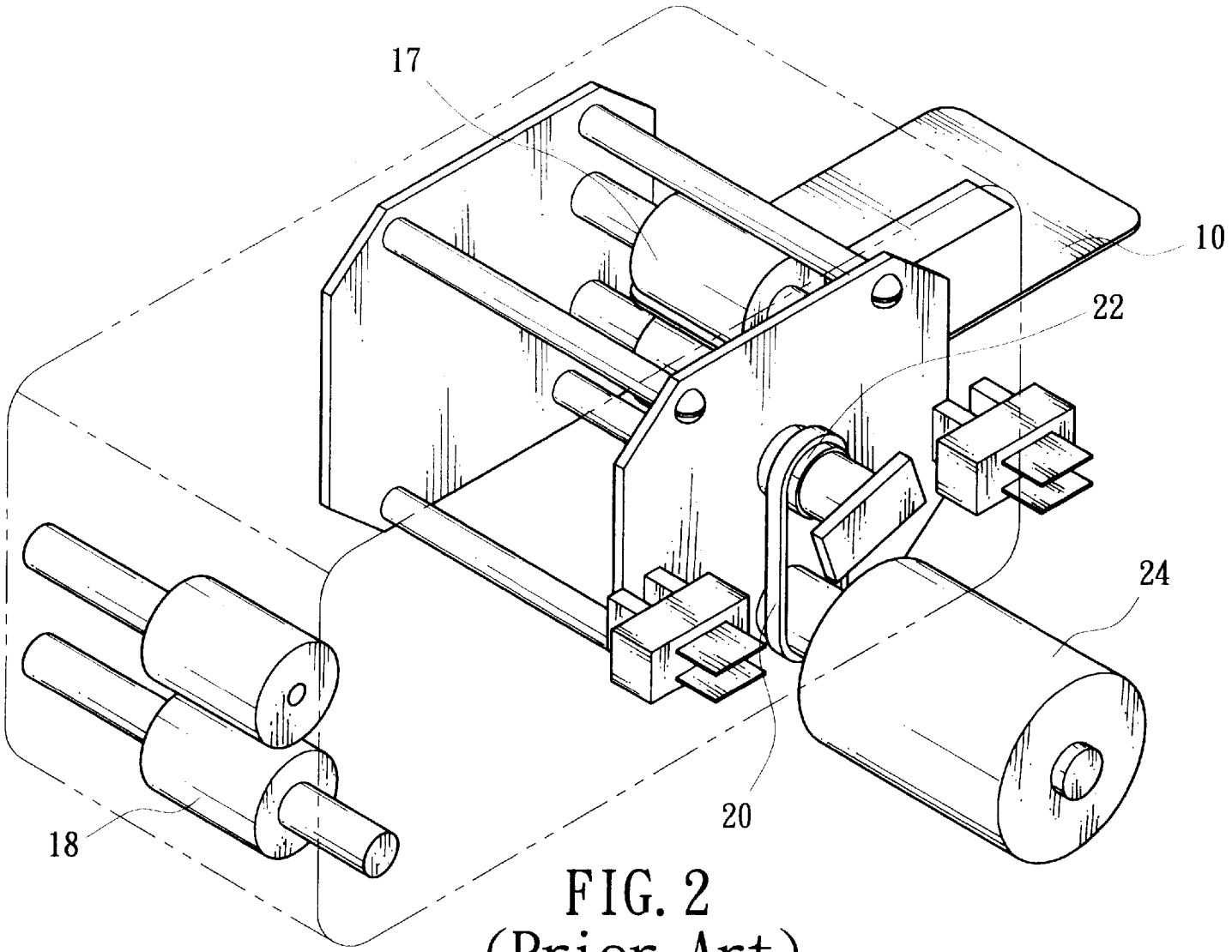
FIG. 2 (Prior Art)
FIG. 2 is another schematic perspective view showing the card-reversing device of an IRIS card printer produced by the NEW CODE Company.
Figure 3:
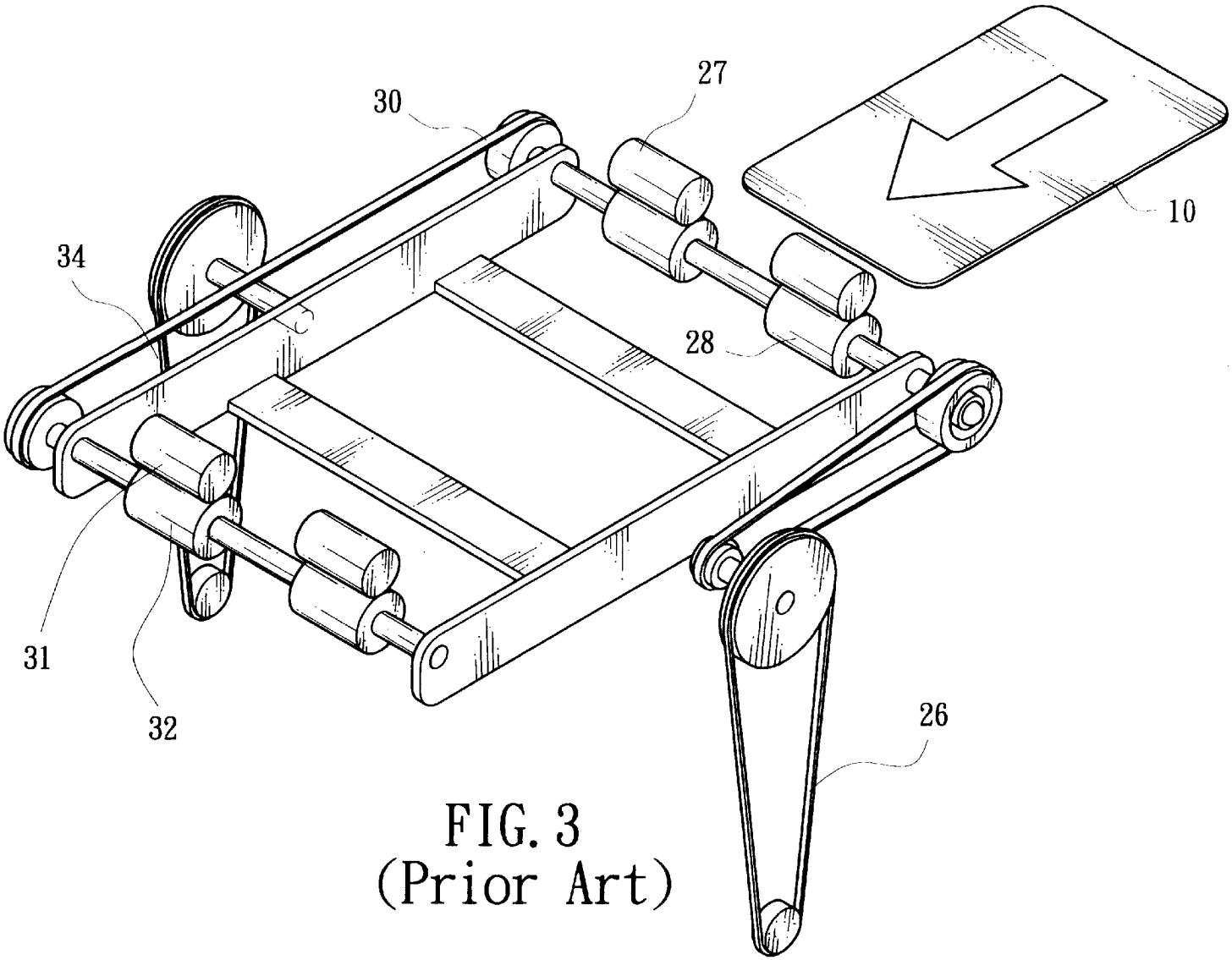
FIG. 3 (Prior Art)
FIG. 3 is a schematic perspective view showing another card-reversing device of the prior art.
Figure 4:
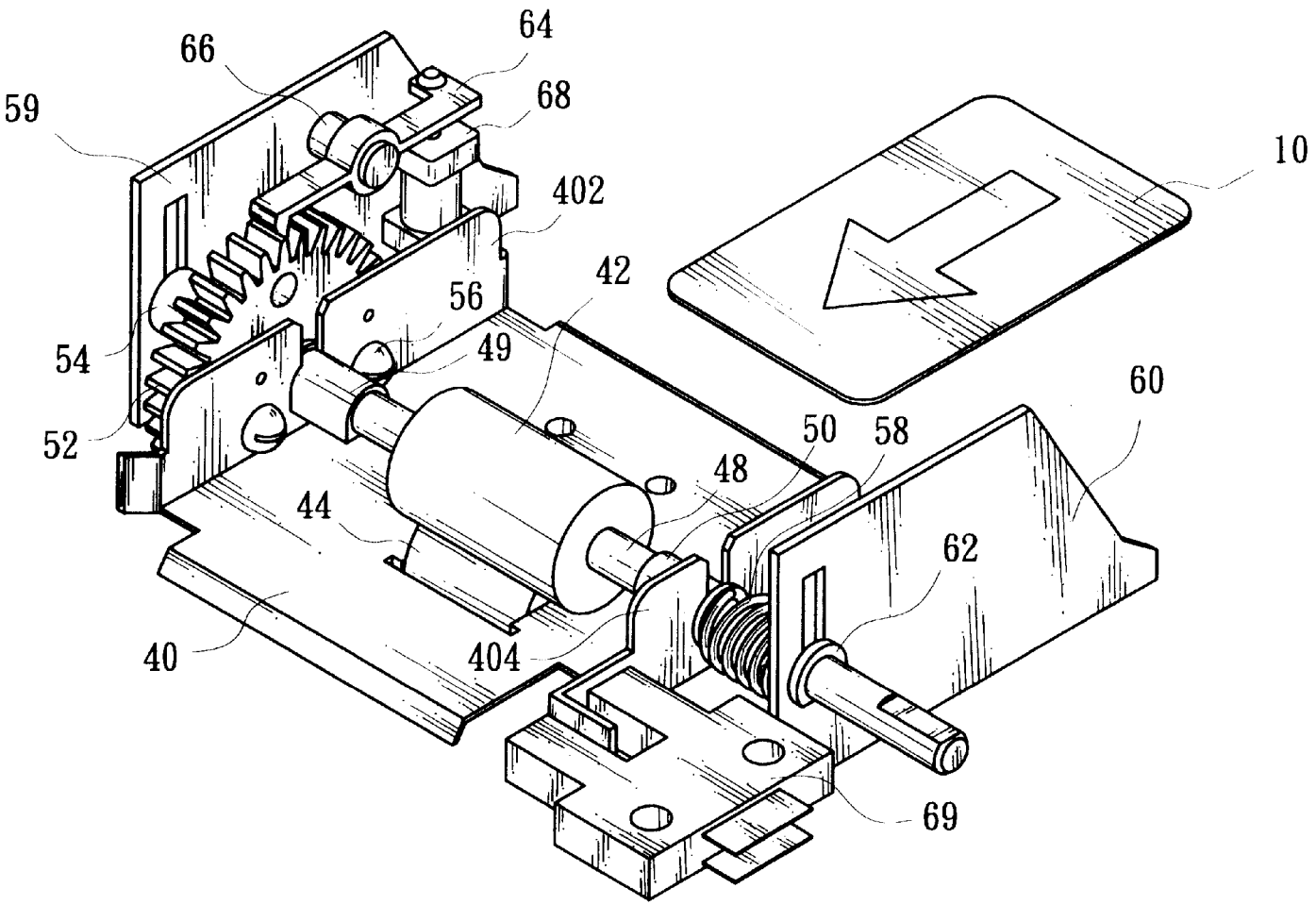
FIG. 4 is a schematic perspective view showing one embodiment of the card-reversing device of this invention.
Figure 5:
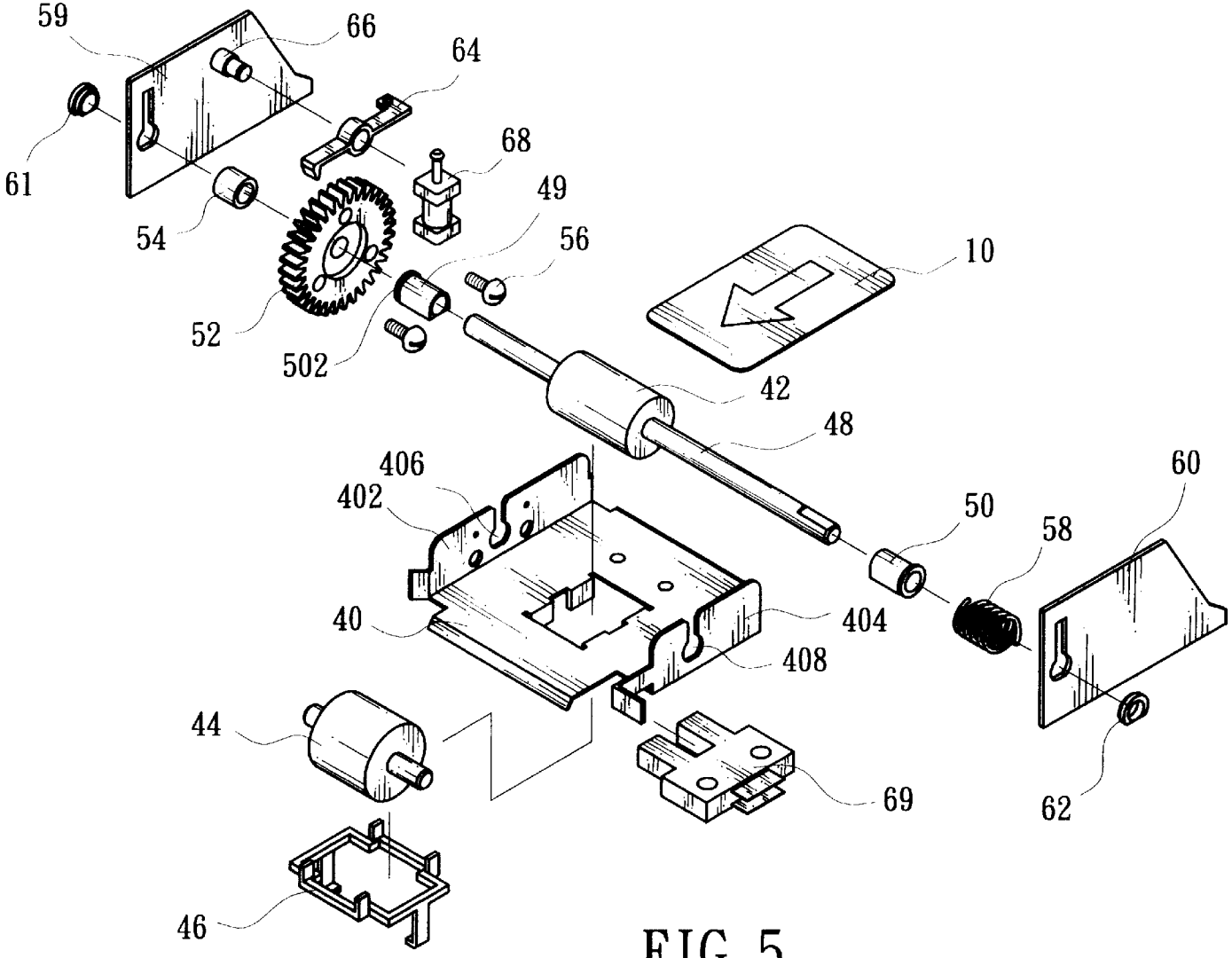
FIG. 5 is an exploded view of the device of FIG. 4.

As schematically illustrated in FIGS. 4 and 5, the card-reversing device according to this invention for use with a card printer to perform printing on both sides of a card 10 includes a rotary mean capable of retaining and turning the card 10 upside down, a transmission unit capable of feeding the card, a lock means capable of controlling the rotation of the rotary mean and a friction medium 70 (shown in FIG. 6) providing a rotation torque transporting from the transmission unit for the rotation of the rotary means. The rotary mean includes a rotary body 40 which has two side walls 402 and 404 for guiding the card movement. There is a pair of holes 406 and 408 on the side walls 402 and 404, respectively. The transmission unit includes a feeding roller 42 mounted on a rotation shaft 48 driven by a feeding motor (not shown in FIGS. 4 and 5) and an idle roller 44 mounted on the rotary body 40 and urged toward the feeding roller 42 by a support base 46 so as to bring the idle roller 44 into press contact with the feeding roller 42. Thus, the idle roller 44 rotates together with the feeding roller 42, thereby moving the card 10 held therebetween.

The rotation shaft 48 is rotatably supported on two non-cylindrical roller bushes 49 and 50. Both roller bushes 49 and 50 fit the paired holes 406 and 408, respectively and each of them has a flange 502 at its one end to prevent sliding toward the idle roller 44 when both roller bushes 49 and 50 are mounted on the side walls 402 and 404 of the rotary body 40. Meanwhile, if the roller bushes 49 and 50 are driven to rotate, the rotary body 40 will also be driven to rotate. At the end of the rotation shaft 48 supported by the roller bush 49, there is a stop gear 52 mounted on a ring 54 and rigidly mounted to the side wall 402 by screws 56 where the ring 54 is mounted on the rotation shaft 48. In addition, a flat board 59 and a support mean 61 are used to clamp the stop gear 52 and the roller bush 49. Similarly, the roller bush 50 is first urged toward the feeding roller 42 by a spring 58 clamped by a second flat board 60 and a second support mean 62 so as to provide smooth rotation of the rotary body 40.

Figure 6:
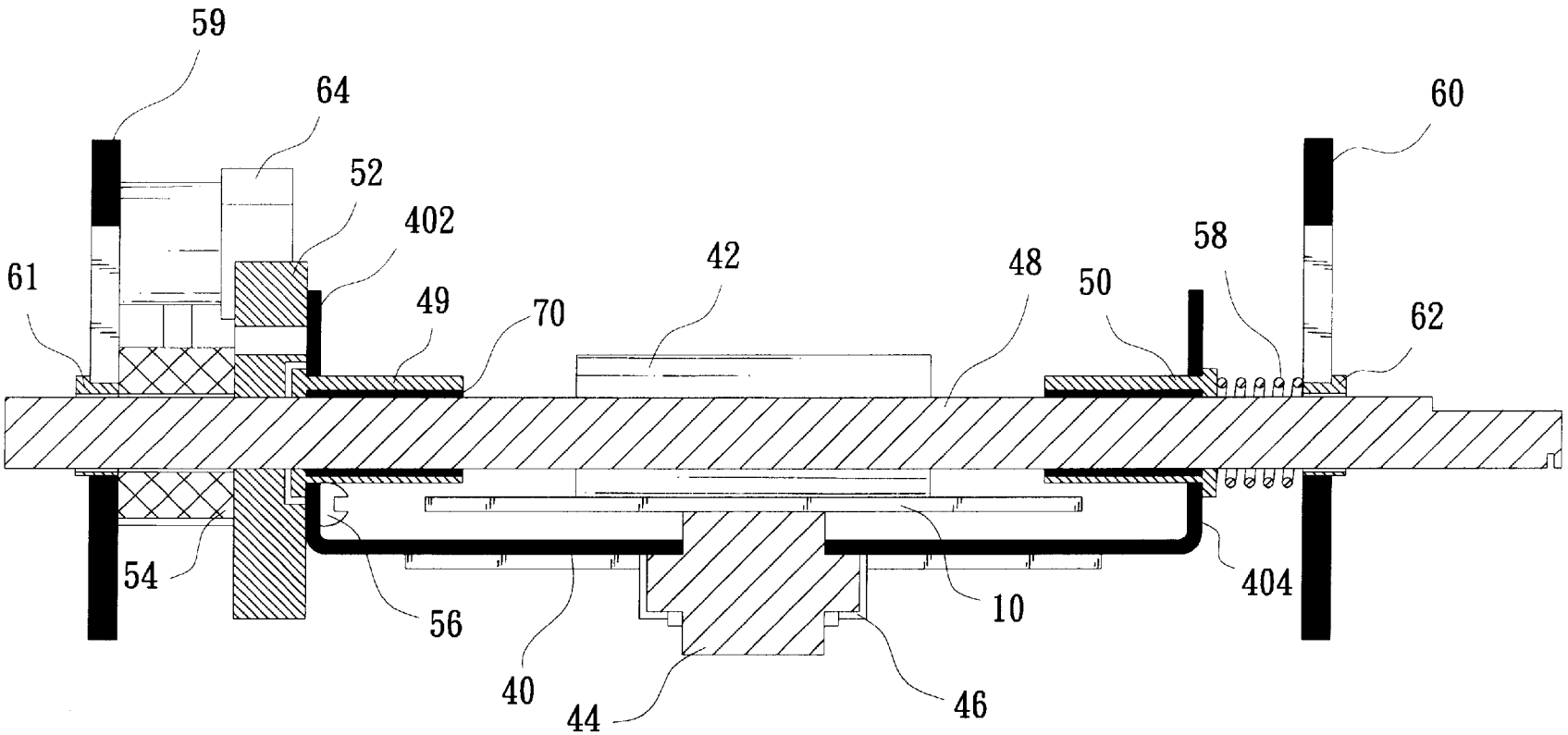
FIG. 6 is a cross-section view of the device of FIG. 4 along its rotation axis.
Figure 7:
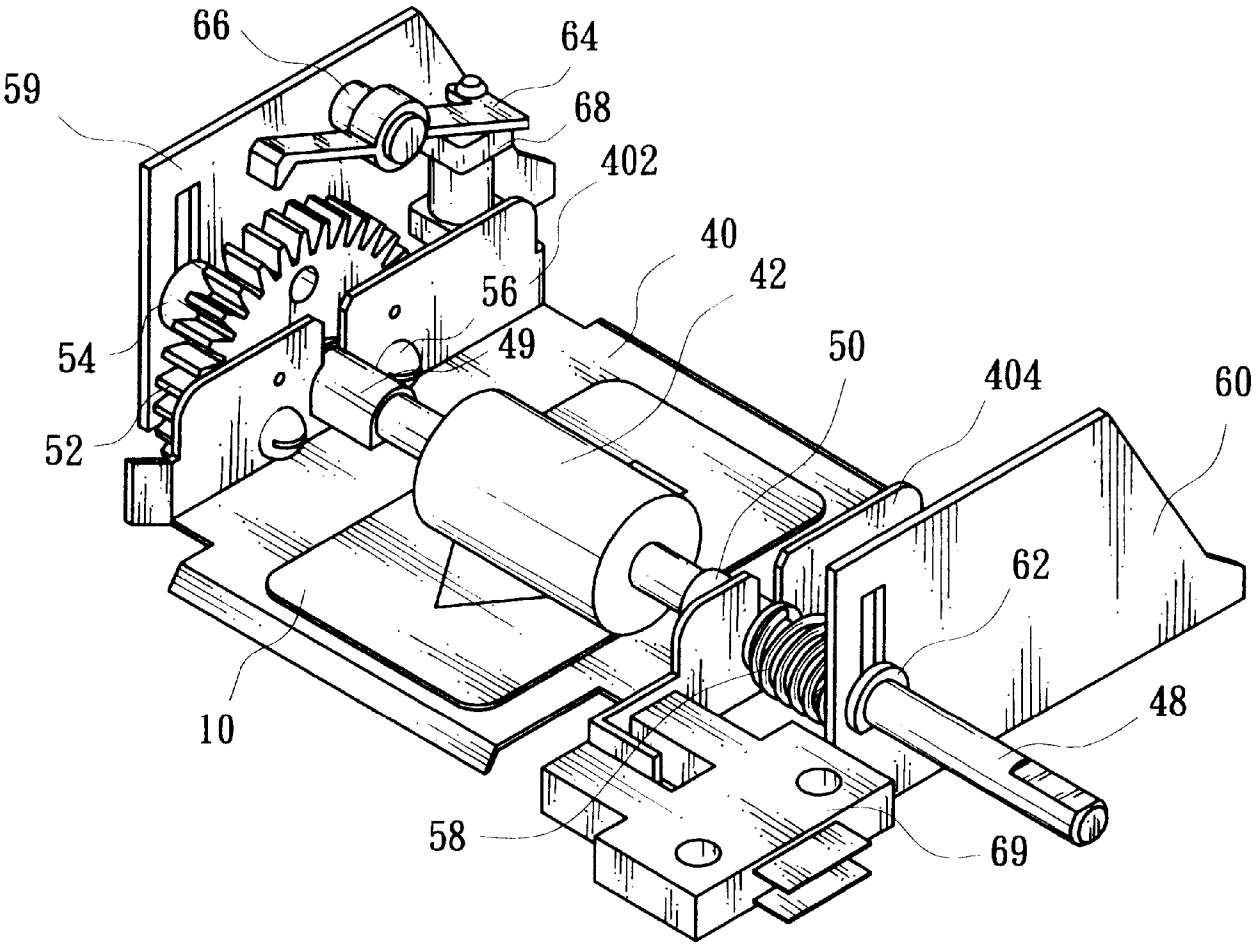
FIG. 7 and 8 are perspective views showing the operational principle of the device of the invention.
Figure 8:
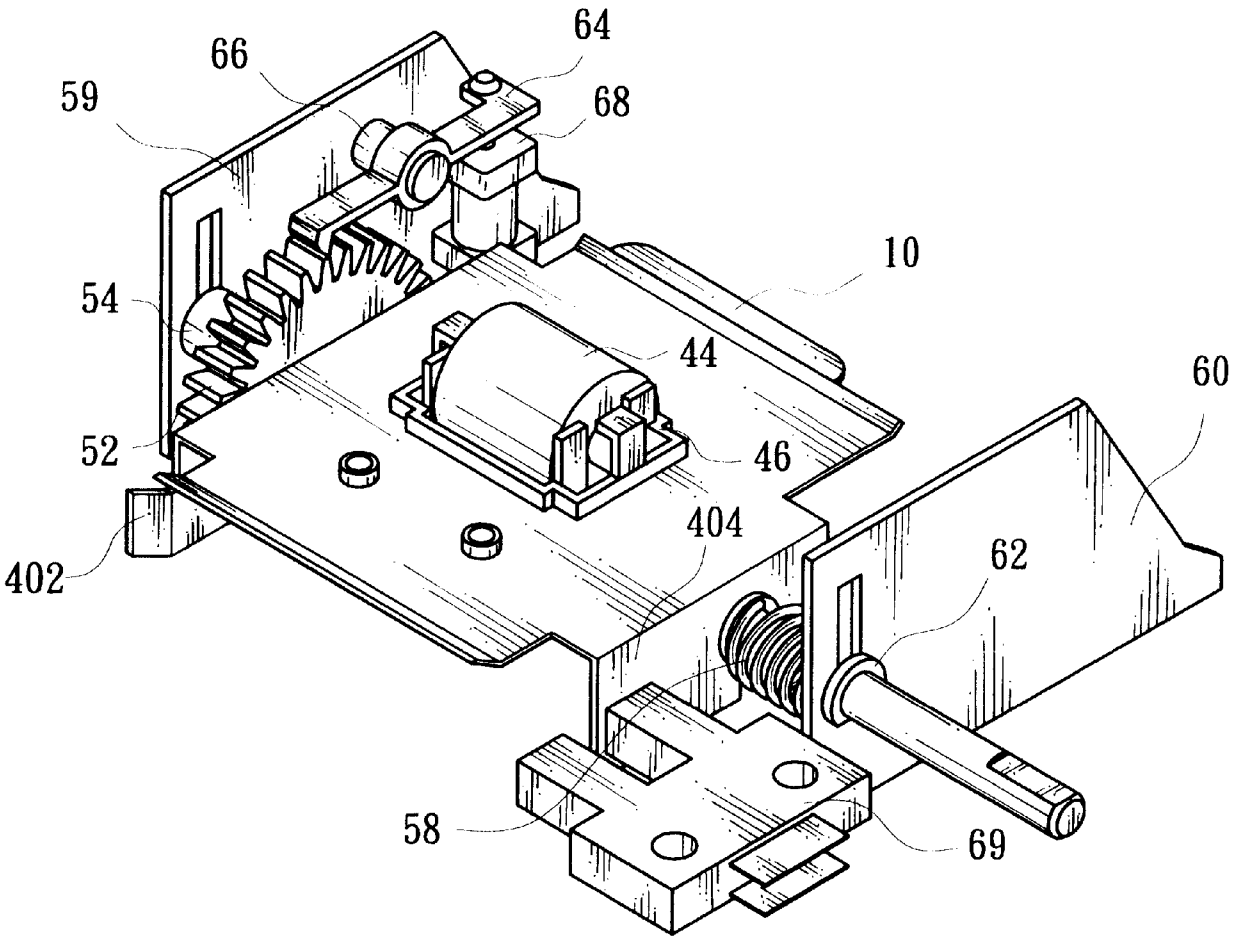
Figure 9:
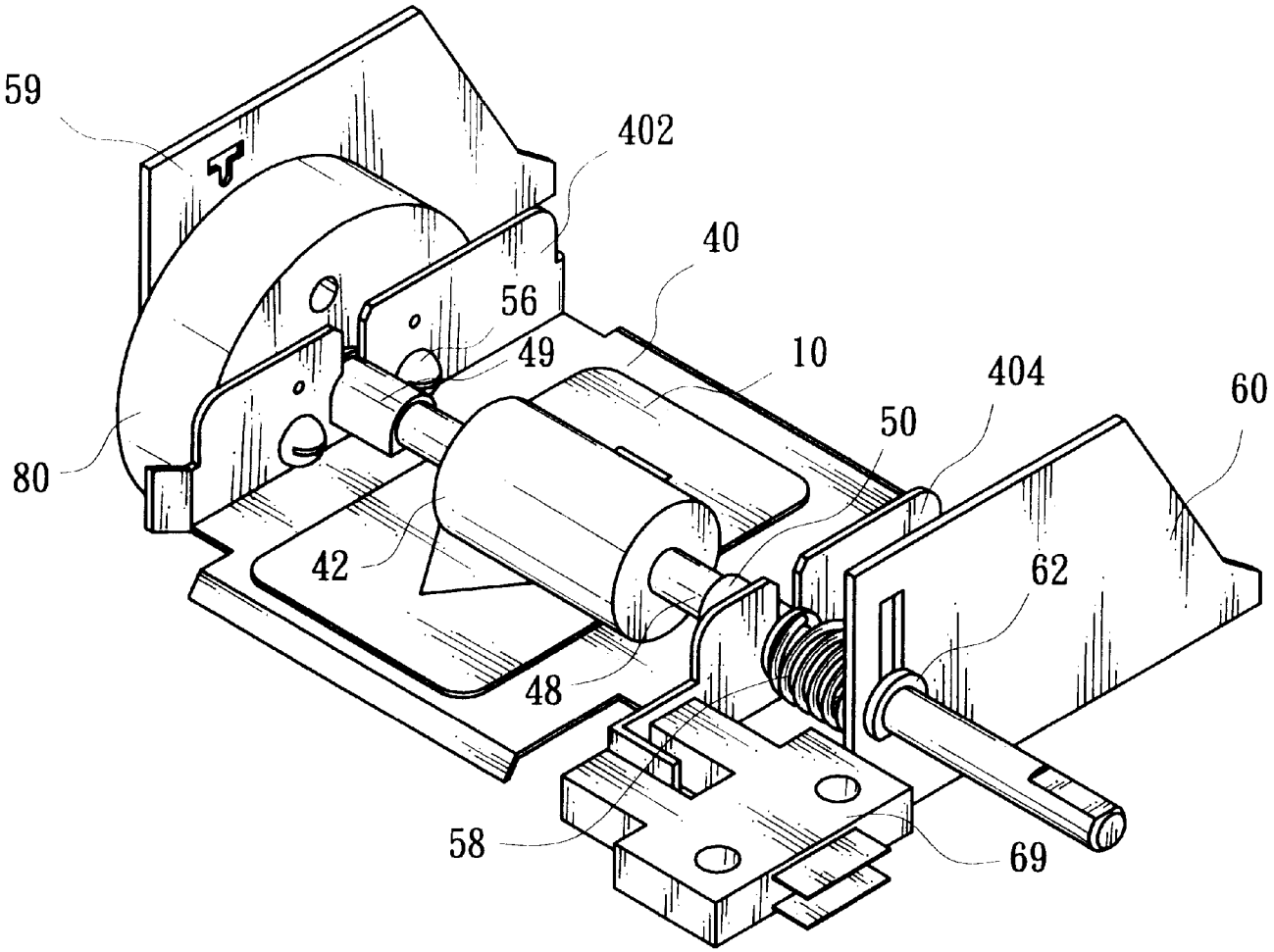
FIG. 9 is a schematic perspective view of another embodiment of this invention.

Referring to FIG. 6, it illustrates the most important design of the invention. The friction medium 70 is disposed between the rotation shaft 48 and each of the roller bushes 49 and 50. The friction medium 70 can be made of viscid film with high viscosity, such as oil or polymer solutions in order to provide rotation torque for the roller bushes 49 and 50. Please refer to FIGS. 7 and 8, which are perspective views showing the operational principle of the device of the present invention. The lock mean includes a bar 64 furnished on a bar 66 of the flat board 59 and used to clamp the stop gear 52 as the card 10 is fed into the rotary body 40. A solenoid 68 controls the clamping operation of the lock bar 64, and a sensor 69 is provided to detect the rotation of the rotary body 40 so as to control the operation of the solenoid 68. As the solenoid 68 is actuated, i.e. start to turn the card 10 over, the end of the lock bar 64 near the solenoid 68 is pull to unlock the stop gear 52. At the time, the friction medium 70 provides the rotation torque transporting from the shaft 48 to rotate the roller bushes 49 and 50 because of viscosity or friction. Thus, the roller bushes 49 and 50 rotate the rotary body 40, and the card is consequently turned over. As the stop gear 52 is braked again, the rotation shaft 48 is still rotated without driving the roller bushes 49 and 50 together. Thus, the rotary body 40 stops to be rotated, and the revolved card 10 is then fed outward by the feeding roller 42. In addition, the friction medium 70 can prohibit the card-reversing device of the invention from damage by abnormally stop during the card turnover operation. FIG. 9 shows another embodiment of the invention in which a brake 80 is used to replace the function of the lock bar 64 and the solenoid 68, and the stop gear 52 is substituted by a friction wheel.

In the present invention, as the lock means brakes the rotation of the rotary means, the transmission unit and the rotary means are separated by the friction medium since the friction medium is made of a viscous film such as oil. Consequently, a card-reversing device according to the present invention is capable of turning over a card without causing damages when the turnover operation is abnormally stopped. As the lock mean is actuated to unlock the rotary means, the friction medium provides the rotation torque transporting from the transmission unit to rotate the rotary mean because of viscosity. In addition, a card-reversing device according to the present invention is simple, easily assembled and inexpensive.

It is noted that card-reversing devices described above are the preferred embodiments of the present invention for the purposes of illustration only, and are not intended as a definition of the limits and scope of the invention disclosed. Any modifications and variations that may be apparent to a person skilled in the art are intended to be included within the scope of the present invention.

what is claimed is:

1. A substrate turning device for use with a printer to perform printing on both sides of a substrate, comprising:

a transmission unit including a rotation shaft driven by a feeding motor for transporting said substrate;

a rotary means mounted on said rotation shaft for retaining and turning said substrate upside down;

a friction medium disposed between the connection of said rotary means and said rotation shaft to transport a rotation torque so that said rotary means can be driven to rotate by said transmission unit; and a brake for alternately braking the rotation of said rotary means;

wherein said brake includes a solenoid, a lock bar and a gear, further wherein said solenoid controls said lock bar to stop the rotation of said gear.

2. The substrate turning device as claimed in claim 1 wherein said substrate is selected from one of paper, card or plastic sheet.

3. The substrate turning device as claimed in claim 1 wherein said transmission unit includes a feeding roller and an idle roller for transporting said substrate held therebetween.

4. The substrate turning device as claimed in claim 1 wherein said rotary means includes a rotary body for retaining said substrate and at least one roller bush mounted on said rotation shaft with said friction medium disposed between said rotary body and said at least one roller bush.

5. The substrate turning device as claimed in claim 1 wherein said friction medium is a viscid film.

6. The substrate turning device as claimed in claim 5 wherein said vicid film is an oil.

7. The substrate turning device as claimed in claim 5 wherein said vicid film is a polymer solution.

8. The substrate turning device as claimed in claim 1 wherein said brake includes a friction wheel for controlling the rotation of said rotary mean by friction.

9. The substrate turning device as claimed in claim 1 wherein said brake is an electromagnetic brake.

* * * * *